United States Patent [19]

Hofer

[11] 3,943,694

[45] Mar. 16, 1976

[54] DIVERS' FLUID-TIGHT WATCH COMPRISING AN ELECTRIC CIRCUIT

[75] Inventor: Peter Hofer, Grenchen, Switzerland

[73] Assignee: ETA A.G. Ebauches-Fabrik, Switzerland

[22] Filed: Aug. 16, 1974

[21] Appl. No.: 497,942

[30] Foreign Application Priority Data

Aug. 30, 1973 Switzerland ..... 12461/73

[52] U.S. Cl. ..... 58/19 C; 58/50 R

[51] Int. Cl.[2] ..... G04C 21/16; G04B 19/30

[58] Field of Search ..... 58/19 C, 50 R, 38, 57.5; 240/6.43

[56] References Cited

UNITED STATES PATENTS

| | | | |
|---|---|---|---|
| 3,611,702 | 5/1969 | Spadini | 58/57.5 |
| 3,727,395 | 4/1973 | Baylor | 58/38 |
| 3,729,923 | 5/1973 | Brigliano et al. | 58/50 R |

*Primary Examiner*—Edith Simmons Jackmon

*Attorney, Agent, or Firm*—Stevens, Davis, Miller & Mosher

[57] ABSTRACT

An arrangement for indicating elapsed time is disclosed that is particularly useful in marine timepieces, divers' wristwatches and the like. The arrangement utilizes a light-emitting member which, upon the lapsing of a predetermined time is energized to give visual indication to the wearer of the elapsed time. A mechanical switching structure is described that is controlled by the movement of the timepiece and which upon closure causes the light emitting member to be energized. An electronic circuit is provided which causes the light emitting member to flash when energized.

6 Claims, 4 Drawing Figures

DIVERS' FLUID-TIGHT WATCH COMPRISING AN ELECTRIC CIRCUIT

This invention relates to a fluid-tight watch comprising an electric circuit, an illuminating member connected into the circuit, and switching means in the circuit and accessible from outside the watch.

Divers' watches are already known which comprise a mechanical indicating device such as a rotatable bezel which the diver sets, just before diving, in terms of the depth to which he expects to descend, and which indicates to him how long he may remain at that depth. The time-limit is reached when the minute-hand of the watch is situated opposite the zero-mark on the bezel.

However, these mechanisms are often difficult to use, especially if the diver intends to go down to any great depth, because the legibility of the markings may be greatly reduced by pollution of the water. If the water is not very clear, light rays do not penetrate it beyond a depth of 4 to 5 m.

It is the object of this invention to provide a watch suitable for use by a diver, which indicates to him the maximum time he may remain at the chosen depth by means which are better visible than markings on a bezel to be positioned about an hour-circle.

To this end, in the fluid-tight watch of the aforementioned type according to the present invention, the circuit comprises a switch which is controlled by the watch movement and which is adjustable so as to cause the illuminating member to be switched on at a predetermined moment.

A preferred embodiment of the invention will now be described in detail with reference to the accompanying drawings, in which.

Figure 1:
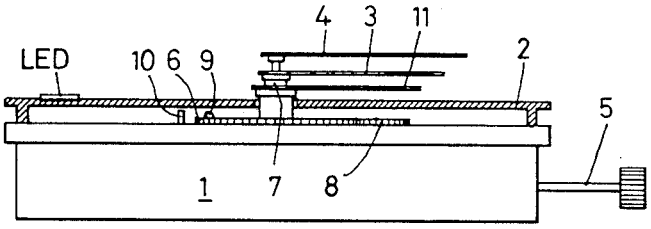
FIG. 1 is a diagrammatic elevation of the watch showing the movement.
Figure 2:
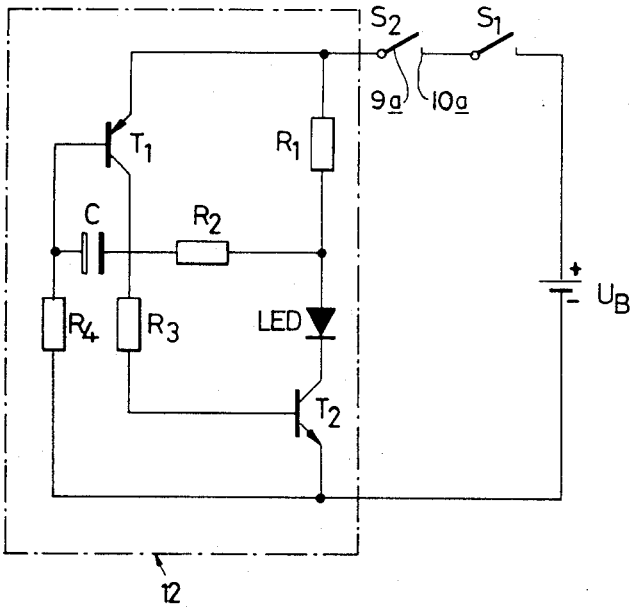
FIG. 2 is an electric circuit diagram.

FIG. 1 shows a watch movement 1 which may be a mechanical or an electrical one. As a display device, this watch preferably comprises a dial 2 with an hour-hand 3 and a minute-hand 4 moving above it. The movement 1 may also comprise a seconds-hands. In addition to the movement 1, the watch-case contains as illustrated in FIG. 2 an electric circuit 12 and a power-source $U_B$ consisting preferably of two miniature batteries connected in series, each having a voltage of about 1.5V or 1.3V. As will be seen further on, the chosen circuit needs a voltage of slightly more than 1.5V to feed it, which is why it is preferable to have two batteries. The batteries are accommodated in the bottom of the watch-case, and one of the poles of the power-source $U_B$ is connected to a first switch $S_1$ controlled by a winding-and-setting stem 5 or by a second stem. The switch $S_1$ will be closed, for example, when the stem is in its inner position.

Figure 3:
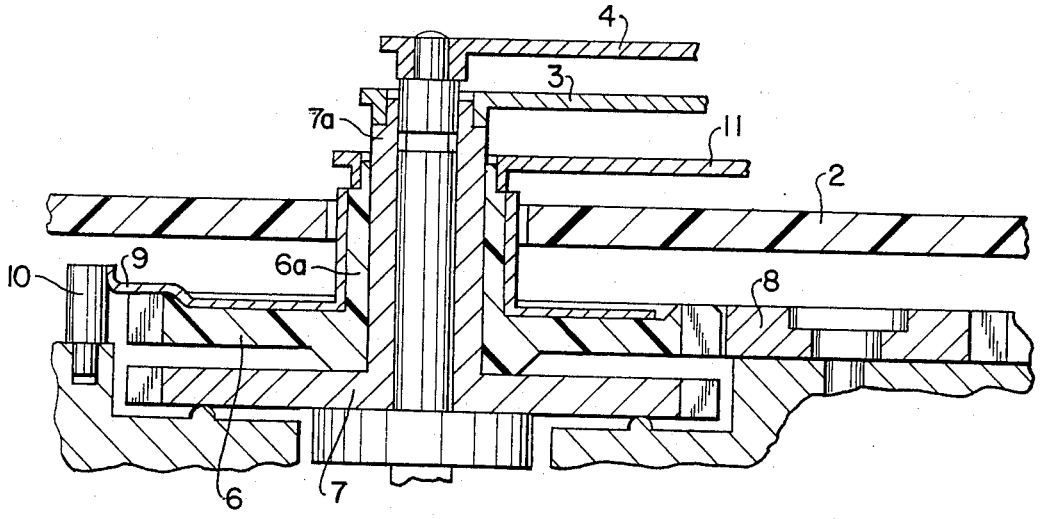
FIG. 3 shows the elevational view of FIG. 1 in cross section and in greater detail.
Figure 4:
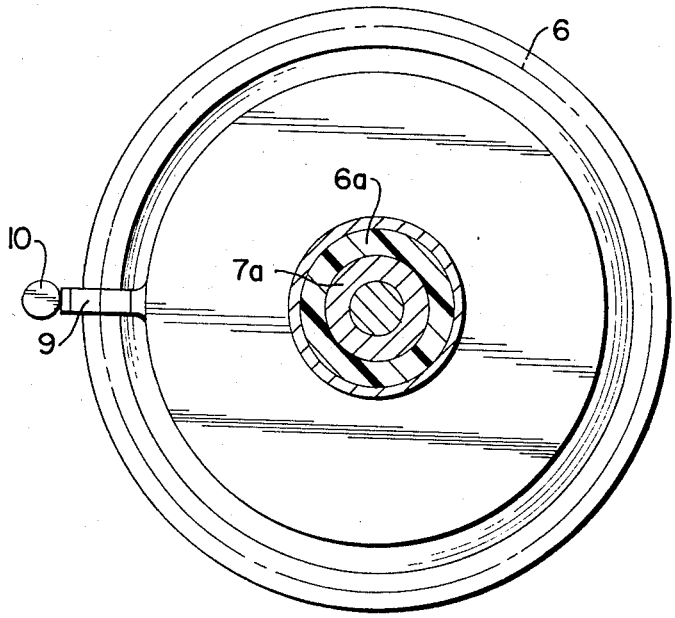
FIG. 4 shows a plan view of FIG. 3 from the top.

The circuit 12 further comprises a second switch $S_2$ illustrated in an open position in FIGS. 1 and 2 connected in series with the first switch $S_1$ and controlled by the movement 1. The second switch $S_2$ may consist of a rotatable toothed wheel 6 coaxial with a pipe 7 of an hour-wheel or with a minute-wheel as shown in FIGS. 1, 3 and 4. It will be adjustable by rotation of the stem 5 in its middle position and via a setting-wheel 8 so as to close at a predetermined moment under the action of the movement 1. Wheel 9 may be in frictional engagement with hour-wheel 7. Movement of wheel 8 may cause the relative position of wheel 6 to change with respect to hour-wheel 7 while wheel 6, by virtue of the frictional engagement may rotate in unison with hour-wheel 7. A movable contact element 9 fastened on the wheel 6 then comes in contact with a fixed element 10 integral with the frame of the movement 1 as illustrated by FIGS. 3 and 4. A hand 11 integral with the wheel 6 indicates on the dial 2 the time at which the closing of the contact will take place. Switches of this type are already known per se and need not be described here. The second switch $S_2$ is so arranged as to reopen several minutes after having been closed. For example, by proper selection of the width of the contact 9, the time in which contacts 9 and 10 remain closed can be controlled. Connected in series with the switches $S_1$ and $S_2$ is an illuminating member LED housed in the dial 2 so as to be visible on the watch. To be more precise, the illuminating member LED consists of an electroluminescent diode which is available on the market. The cathode of this diode LED will be connected to the negative pole of the power-source $U_B$, its anode being connected to the positive pole of the power-source $U_B$ via the switches $S_1$ and $S_2$.

In an embodiment such as has just been described, the diode LED becomes luminescent when the hands show the time corresponding to the setting of the second switch $S_2$. It remains lit for several minutes and then goes out.

In order to save on current from the batteries and to heighten the warning effect of the diode LED, it is likewise possible to provide another arrangement of the electric circuit such as is shown in FIG. 2.

FIG. 2 shows a power-source $U_B$, a preparatory switch $S_1$ controlled by the winding-and-setting stem, and a main switch $S_2$ controlled by the movement so as to close at the intended time. The numerals 9*a* and 10*a* designate elements corresponding to the contacts 9 and 10 illustrated schematically in FIG. 2. Also shown is an electroluminescent diode LED, the anode of which is connected to the positive pole of the power-source $U_B$ across a resistor $R_1$ and across the two switches $S_2$ and $S_1$. The cathode of the diode LED is connected to the collector of an n-p-n transistor $T_2$, the emitter of which is connected to the negative pole of the power-source $U_B$. The base of the transistor $T_2$ is connected to the collector of a p-n-p transistor $T_1$ across a resistor $R_3$, so that when the transistor $T_1$ becomes conductive and carries the current coming from the positive pole of the power-source $U_B$ through its emitter, the base voltage of $T_2$ causes the flipping of the transistor $T_2$, which goes into the conductive state. The base of the transistor $T_1$ is connected across a resistor $R_4$ to the negative pole of the power-source $U_B$ and to one of the electrodes of a capacitor C, the other electrode of which is connected across a resistor $R_2$ to the anode of the electroluminescent diode LED. The capacitor C and the resistor $R_2$ make up a delay circuit which causes the alternate flipping of the transistors $T_1$ and $T_2$ and, consequently, the emission by the diode LED of successive flashes of light, the frequency of which may be adjusted to a value of 2 or 3 per second, for example, by selecting suitable values for the resistors and the capacitor.

The operation is as follows: The moment the two switches $S_1$ and $S_2$ are closed, the two transistors $T_1$ and $T_2$ are blocked. The capacitor C charges across the resistors $R_1$ and $R_2$. When the voltage differential between the emitter and the base of the transistor $T_1$ reaches about 0.5V, the emitter-collector circuit of this transistor becomes conductive, so that the transistor $T_2$ flips, and the circuit composed of the resistor $R_1$, the diode LED, and the transistor $T_2$ becomes conductive. The capacitor C discharges through the resistor $R_2$ and through the circuit of the diode LED and the transistor $T_2$, and the current which passes into the diode LED causes it to light up. However, the moment the capacitor C has discharged, the base of the transistor $T_1$ again reaches a voltage which causes the blocking of this transistor. The transistor $T_2$ is likewise blocked when the potential of its base drops below the flipping threshold, so that the diode LED ceases to be luminescent, but the capacitor C recharges, and the process described above recommences. The frequency of the circuit will preferably be from 2 to 3 c/s.

With this circuit, the two transistors $T_1$ and $T_2$ are conductive and saturated at the same time. Moreover, the circuit requires only one capacitor.

If desired, the circuit described here might also be supplemented by providing several different colored diodes connected in parallel. If need be, a commutator might also be provided in the circuit in order to enable one or the other of the electroluminescent diodes to be switched on at will. This commutator might, of course, be combined with the preparatory switch. It would suffice for it to comprise a position in which all its line were open.

What is claimed is:

1. A fluid-tight diver's watch comprising a movement, an electric circuit, an electroluminescent diode connected into said circuit, and switching means in said circuit and accessible from outside said watch, wherein said circuit comprises a switch which is controlled by the movement of said watch and which is adjustable so as to cause said illuminating member to be switched on at a predetermined moment.

2. A watch in accordance with claim 1, wherein said circuit further comprises a preparatory switch controlled by a control member accessible from outside said watch.

3. A watch in accordance with claim 2, wherein said control member is a stem passing through a sidewall of the case of said watch, said preparatory switch being closed when said stem is in its inner position.

4. A watch in accordance with claim 1, wherein said circuit further comprises an astable multivibrator causing the emission of successive flashes of light from said illuminating member when said switch is closed.

5. A watch in accordance with claim 4, wherein said astable multivibrator comprises an n-p-n transistor and a p-n-p transistor connected in cascade and an RC circuit, said illuminating member being connected into the collector circuit of said n-p-n transistor.

6. An elapsed time indicating device for a fluid-tight diver's watch having a movement, said indicating device comprising a solid state electroluminescent device visible on the face of said watch, an electric circit for energizing said solid state electroluminescent device, a first switching means accessible from the outside of said watch for energizing said circuit, a second switching means in said circuit actuated by the watch movement and adjustable so as to be actuated after the lapse of a predetermined time and remain actuated for a predetermined time, said electroluminescent device being energized by said circuit during the actuation of said second switching means.

* * * * *